US012276059B2

(12) United States Patent
Mullan et al.

(10) Patent No.: US 12,276,059 B2
(45) Date of Patent: Apr. 15, 2025

(54) VARIABLE GRASS-LENGTH INJECTION

(71) Applicant: SISGRASS B.V., Zaandam (NL)

(72) Inventors: George Alexander Mullan, Cregg (IE); Thomas Schuurman, Nederhorst Den Berg (NL); Ivo Johannes Gerardus Lamot, Assendelft (NL); Eduard Andreas Galesloot, Nederhorst Den Berg (NL)

(73) Assignee: Sisgrass B.V., Zaandam (NL)

( * ) Notice: Subject to any disclaimer, the term of this patent is extended or adjusted under 35 U.S.C. 154(b) by 0 days.

(21) Appl. No.: 18/555,931

(22) PCT Filed: Apr. 19, 2022

(86) PCT No.: PCT/EP2022/060280
§ 371 (c)(1),
(2) Date: Oct. 18, 2023

(87) PCT Pub. No.: WO2022/223538
PCT Pub. Date: Oct. 27, 2022

(65) Prior Publication Data

US 2024/0200251 A1 Jun. 20, 2024

(30) Foreign Application Priority Data

Apr. 19, 2021 (NL) ..... 2028007
Jul. 26, 2021 (NL) ..... 2028838

(51) Int. Cl.
*D05C 15/10* (2006.01)
*D05C 15/14* (2006.01)

(52) U.S. Cl.
CPC ..... *D05C 15/10* (2013.01); *D05C 15/14* (2013.01); *D10B 2505/202* (2013.01)

(58) Field of Classification Search
CPC ..... D05C 15/08; D05C 15/10; D05C 15/12; D05C 15/16; D05C 15/18; D05C 15/20; D05C 15/32
See application file for complete search history.

(56) References Cited

U.S. PATENT DOCUMENTS 3,937,156 A 2/1976 Spanel
4,127,078 A * 11/1978 Spanel ..... D05C 15/16 112/80.71

(Continued)

FOREIGN PATENT DOCUMENTS

AU 2020101010 A4 8/2020
WO 0179611 A1 10/2001

(Continued)

OTHER PUBLICATIONS

PCT International Search Report and Written Opinion dated Jul. 7, 2022, for International Application No. PCT/EP2022/060280.

(Continued)

*Primary Examiner* — Danny Worrell
(74) *Attorney, Agent, or Firm* — Patterson + Sheridan, LLP

(57) ABSTRACT

Yarn injection device for injecting yarn sections into a substrate, wherein the yarn injection device comprises:—a yarn storage for holding a number of spools with yarn,—a feeding device configured to feed lengths of yarn to an injection unit, the feeding device comprising: •a number of yarn tubes, each yarn tube defining a yarn channel configured to accommodate a respective yarn, •a number of cutting devices located being configured to cut a number of yarn sections,—the injection unit comprising: •an injection needle guide defining a number of first passages extending over a vertical distance and a number of second passages extending over a horizontal distance, •a number of moveable injection needles configured to pass through the first holes of (Continued)

the injection needle guide, wherein yarn sections in the yarn tubes located below the moveable injection needles are injected into the substrate when the moveable injection needles move downward through the injection needle guide, •at least one needle actuator configured to move the number of moveable injection needles,—a fluid flow assembly, wherein at least one fluid communication channel extends between the injection needle guide and the depressurized or pressurized compartment, wherein the fluid flow assembly is configured to create a flow of fluid through each fluid communication channel, each injection needle guide and each yarn tube in order to apply a drag force on the yarns and move the yarns through the second passages in the injection needle guide.

20 Claims, 10 Drawing Sheets

(56) References Cited

U.S. PATENT DOCUMENTS 4,549,496 A * 10/1985 Kile ..... D05C 15/34 112/80.08
5,481,991 A * 1/1996 Geerts ..... E01C 13/08 111/901
6,938,565 B2 * 9/2005 Geerts ..... D05C 15/08 112/80.57
9,683,335 B2 * 6/2017 Schuurman ..... E01C 13/08
10,858,771 B2 * 12/2020 Bruske ..... D05C 15/18

FOREIGN PATENT DOCUMENTS

WO 2016122312 A1 8/2016
WO 2018074930 A1 4/2018
WO 2019027317 A1 2/2019
WO 2020214028 A1 10/2020

OTHER PUBLICATIONS

Netherlands Search Report dated Dec. 20, 2021, for Netherlands Patent Application No. 2028007.
Netherlands Search Report dated Mar. 31, 2022, for Netherlands Patent Application No. 2028838.

* cited by examiner

VARIABLE GRASS-LENGTH INJECTION

FIELD OF THE INVENTION

The invention relates to the field of inserting yarn sections into substrates and in particular to a device and a method to insert yarn sections into a substrate.

BACKGROUND OF THE INVENTION

In the field of inserting yarn sections into substrates, various device and methods exist.

An example of such a device and method is disclosed in WO0179611A1. In the device, a fiber is fed through a tube to a position under an insertion device that is configured to insert the fiber into the ground below. The fiber which is unwound from a roll first passes through a tube before being pulled by a pair of rollers that are configured to feed the fiber further into the device. The fiber is then passed through a venturi device that blows the fiber further through the device. Subsequently a clamp closes and the fiber is cut into a section by a rotatable element. The rotatable element is provided with a passage that is initially coaxial with the tube. By rotating the element, an edge of the passage moves past an edge of the tube, and in doing so shears the fiber. Thereafter, the fiber is inserted into the ground by a pin.

A drawback of the machine is that pressurized air is fed into the tube to force the fiber through the tube. The pressurized air is fed into the tube via a venturi device. Just after the pressurized air joins the tube, the pressure and the velocity of the air will rapidly decrease inside the tube. This means that the force exerted on the fiber will also rapidly decrease. To overcome this issue, a large compressor is necessary. The large compressor is expensive, heavy, and requires a lot of power to operate.

Another potential issue that may be associated with the use of compressed air is that the air may escape at the location where the injection pin is positioned because the pin must move downwards there. There is an open space through which the pin moves in a vertical direction. This open space intersects the tube through which the fiber is fed. The pressurized air may leak at the intersection and escape outwards via the open space. On the other (downstream) side of the open space, a subsequent tube is positioned into which the fiber must be moved. The interruption of the tubes guiding the fiber causes a decrease in the force exerted on the fiber because air leaks away via the open space. Also, the air escaping through the open space between the tubes may take the fiber with it and out of the system. This may jam the device.

Additionally by moving the injection pins relative to the cutting device to adjust the length of the fiber that is to be injected, the size of the open space may increase. This increases the risk of jamming of the machine due to the fiber exiting the device.

WO2016122312A1 discloses a device for inserting artificial grass strands into the ground and makes use of a rotating drum on which several grass strands are placed next to each other. On the drums, clamps are provided that clamp down the strands between a front clamp and rear clamp so that the strands rotate with the drum. Subsequently, a cutting device then cuts the strands into sections and these section are rotated to below injection needles that inject the sections into the ground.

A potential drawback of the device of this document is that the drum is a large and heavy moving object that has to be intermittently rotated and stopped. Accelerating and decelerating heavy components takes a relatively large amount of energy and requires a strong frame to be able to react to the accelerations and decelerations. The relation between accelerating and decelerating and the required energy and strong frame limit the amount of strands that can be inserted into the ground. A higher insertion frequency would mean faster movements of the heavy drum and would need an increasingly stronger frame and more powerful actuation.

Also, because the drum is rotating and it comprises moveable actuated components such as clamps, a complex control system for these components must be present that is able to communicate with the moving, rotating components while being stationary itself.

AU2020101010A4 discloses a device for making a stitched hybrid turf and makes use of an airflow to deliver the fiber to the injection pins. The device comprises a translatable tube through which compressed air flows to an extremity, wherein the compressed air delivers a fiber to the extremity of the tube. The tube is subsequently moved in a lateral direction to a position under a plurality of pins. In this position, the fiber inside the tube is clamped by a clamp before the tube returns to its initial position. Here, the fiber is clamped by another clamp located at the extremity of the tube. Thereafter, the fiber is pressed against the ground by pressing elements, cut by cutting elements and inserted into the ground by injection pins.

A drawback of the device is that for it to function, the pressing elements, cutting elements, and insertion pins have to be placed so far apart that the distance between each subsequent needle has to be twice the penetration depth of the needle. This means that the tube transporting the fiber must be extremely long for an increasing number of pins.

WO2019027317A1 discloses a device an method for inserting yarn sections into substrates. The device comprises a drum with a plurality of clamps positioned around the circumference of the drum. The device has a capability of inserting yarn sections in two different depths. It was recognised in the present invention that this is a drawback in the sense that it would be advantageous to have a capability of inserting yarn sections in more than two different depths into a substrate.

OBJECT OF THE INVENTION

It is an object of the invention to provide a device and a method for inserting yarn sections into a substrate, and, in doing so, overcoming at least one of the abovementioned drawbacks.

It is a further object to provide a device and a method for inserting yarn sections into a substrate wherein the device has a capability of inserting in more than two different insertion depths.

SUMMARY OF THE INVENTION

In order to achieve at least one of the objectives, the present invention provides a yarn injection device for injecting yarn sections into a substrate, wherein the yarn injection device comprises:

- a yarn storage comprising a number of spool holders for holding a number of spools with yarn,
- a feeding device configured to feed lengths of yarn via respective supply paths from the storage to an injection unit, the feeding device comprising:

a number of yarn tubes, each yarn tube defining a yarn channel configured to accommodate respective yarns, a number of cutting devices located at a side of the yarn tubes and being configured to cut a number of yarn sections from the respective yarns extending from the yarn storage into the yarn tubes, the injection unit comprising:

an injection needle guide defining a number of first passages extending over a vertical distance and a number of second passages extending over a horizontal distance, wherein each first passage intersects a respective second passage, and wherein each yarn channel is fluidly connected to a respective second passage, a number of moveable injection needles moveable between an upper needle position and a lower needle position and configured to pass through the first holes of the injection needle guide, wherein when yarn sections in the yarn tubes are located below the moveable injection needles and the moveable injection needles move downward through the injection needle guide, the yarn sections are injected into the substrate, at least one needle actuator configured to move the number of moveable injection needles between the upper needle position and the lower needle position, a fluid flow assembly comprising at least one fluid communication channel and a depressurized or pressurized compartment having an underpressure or an overpressure, wherein the at least one fluid communication channel extends between the injection needle guide and the depressurized or pressurized compartment, wherein the supply paths extend from the respective spool holders via the feeding device to the injection unit, and the feeding device is configured to supply yarns to the injection unit and wherein the fluid flow assembly is configured to create a flow of fluid through each fluid communication channel, each injection needle guide and each yarn tube in order to apply a drag force on the yarns and move the yarns through the second passages in the injection needle guide.

By using such a device, a flow of fluid can be used to exert a drag force on the yarns, pulling the yarns through the device. In particular the yarns can be pulled through the injection needle guide. In the injection needle guide, the use of the first and second passages reduces the leakage through open spaces and advantageously reduces the pressure drop in the device. It may also be envisaged that multiple or all first and/or second passages may be connected with each other. An example of this would be at least two passages being horizontally connected to form a slit instead of two separate passages. This may be beneficial for the weight of the system and may reduce pressure difference loss due to a smaller friction surface for the fluid travelling inside the second passage.

In an embodiment, the at least one fluid communication channel comprises a channel valve located between the depressurized or pressurized compartment and the injection needle guide. The channel valve may be moveable between an open state and a closed state, wherein in the open state the channel valve allows communication of a fluid flow between the depressurized or pressurized compartment and the injection needle guide, the number of yarn tubes, and/or the feeding device. In the closed state the channel valve inhibits communication of a fluid flow between the depressurized or pressurized compartment and the injection needle guide, the number of yarn tubes, and/or the feeding device. In particular the used fluid may be air.

By being able to switch the channel valve between an open state and a closed state, the communication of the fluid flow may be regulated. The regulation of the fluid flow prevents the need for a system that continuously creates a pressure difference. The present device may create a pressure difference only when it needs the pressure difference. In doing so, the costs can be minimized; both the costs of building the device, as well as the operational costs due to energy consumption.

In an embodiment, the feeding device is configured to feed adjustable lengths of yarn to the injection device. In doing so, no more than the necessary amount of yarn is injected into the ground. Not only does this enable the user of the device to tailor the injected yarns, i.e. the a hybrid pitch, to a the required needs, it also means that no more plastic than necessary is injected into the ground. Besides reducing costs, it also reduces the impact on the environment.

In an embodiment, the number of yarn tubes are extendable tubes extending between the injection needle guide and the cutting devices and wherein the cutting device is moveable with respect to the intersection of the first passages and the second passages to vary the length of the extendable tubes. Here, extendable is meant in the broadest sense of the word and thus comprises bellow, telescopic tubes, etc.

By using extendable tubes and moveable cutting devices, the length of a yarn section can be varied without increasing the open space through which leakage could occur. This is beneficial because the system can easily be adjusted for the circumstances required. For example, when injecting yarn sections in a football pitch, a desired injection depth could vary as a function of underground obstacles such as irrigation pipes. By easily being able to adjust the length of the yarn sections, the injection depth can be adapted over a continuous range without having to change out component and the like.

In an embodiment, the number of yarn tubes comprise a bellow or a telescoping tube. With a bellow or a telescoping tube, a translational degree of freedom can be achieved in a compression direction of the bellow or the telescoping tube. This allows a continuous varying of the depth.

In an embodiment, each of the number of yarn tubes comprises a telescopic tube. Each telescopic tube comprises at least two tubes wherein a first tube fits within a second tube. This allows the yarn tube to shorten or to lengthen, also allowing a continuous varying of the depth.

In an embodiment, the telescopic tube is made out of a metal, in particular copper, and an inner diameter of the first tube substantially matches an outer diameter of the second tube. This allows a good communication of pressure differences without there being too much leakage.

In an embodiment, the distance from the cutting device to the intersection is adjustable over a continuous range of preferably 40-300 mm, more preferably 55-350 mm, even more preferably 90-200 mm in a stepless manner.

In an embodiment, the yarn is not clamped prior to or during cutting. By not needing a clamping step, one less moving component is needed resulting in lower cost and in the device potentially requiring less maintenance.

In an embodiment, the feeding device comprises at least one roller and the rotation of the at least one roller feeds yarn to the injection device.

Such a roller may feed the yarn from the yarn storage. Herein the roller may perform the task of the pulling of the fiber and leave only the guiding of the fiber to the fluid flow assembly. Additionally, the use of a roller permits the relatively straight forward determining of the amount of yarn that has passed; one revolution is a specific length of yarn. By measuring or controlling the revolutions, this can be used to feed a predetermined amount of yarn into the injection unit.

In an embodiment, the feeding device comprises two rollers and the yarn passes between the two rollers.

In an embodiment, the at least one roller has a continuous surface or has a substantially sinusoidal surface. By using a continuous surface, a yarn located between the rollers will always be gripped upon. Alternatively by using a roller with a sinusoidal surface, a yarn may be kept in alignment with a tube.

In an embodiment, the at least one roller is connected to the number of cutting devices and the number of cutting devices are connected to the number of yarn tubes. The feeding device and the number of cutting devices may be moveable together with the cutting device with respect to the intersections.

In an embodiment, a distance between the number of cutting devices and the at least one roller remains constant by being fixed relatively to each other when the number of cutting devices and feeding device are moved with respect to the intersections.

By connecting the at least one roller to the cutting devices or by moving them together, the path that the yarn will follow in between the two will not change.

In an embodiment, the feeding device comprises a plurality of feeding tubes and each feeding tube extends between the at least one roller and a respective cutting device.

This number of feeding tubes may be flexible to compensate for any movement between the at least one roller and the number of cutting devices. However, if only little movement is present, the number of feeding tubes may also be rigid. A number of rigid feeding tubes may well be combined with the constant path between the cutting devices and the at least one roller.

In an embodiment, the device further comprises a cutting device moving system configured to move the cutting devices towards or away from the intersection. This system may be used to vary the length of the yarn section. In particular it may be used to vary the lengths of the yarn sections for all of the number of cutting devices at once.

In an embodiment, the device comprises multiple cutting devices, in particular three cutting devices. Even though a single cutting device may also be used, the use of multiple cutting devices simplifies maintenance. For example, smaller parts may be used that make the handling of those parts easier. Also if one component breaks down, not everything has to be replaced; only one smaller component has to be replaced.

In an embodiment, the supply path, the feeding tube, and/or the at least one fluid communication channel are flexible and/or moveable.

In an embodiment, the at least one fluid communication channel is located on an opposite side of the injection needle guide with respect to the at least one yarn tube.

In an embodiment, the fluid flow assembly further comprises a suction pump and a suction buffer tank. Herein, the fluid communication channel is connected to the suction pump and/or the suction buffer tank and the suction buffer tank is the depressurized compartment.

In doing so, an underpressure can be created on a side of the injection needle guide and can be communicated to the components on the other side of the injection needle guide via the fluid communication channel. In other words, a pressure difference may be created between the suction buffer tank and any component between the suction buffer tank and the yarn storage. This creates a substantially uniform fluid flow wherein the drag force exerted on the yarn does not vary substantially throughout the device.

A further advantage of underpressure over overpressure is that the air flow is converging for underpressure whereas it is diverging (or bifurcating) for overpressure. A diverging air flow brings with it a higher risk that in case of a leak or gap in the system, air will flow out of the system, away from the supply path of the yarn. A front tip of the yarn strand may follow the leaking air flow and enter into the leak. This risk is smaller with underpressure, because if there is a leak, the air will enter the system through the leak and converge towards the intended supply path. The tip of the yarn strand will not have the tendency to exit through the leak. The converging air flow keeps the yarn strands on the intended supply path.

In an embodiment, the suction buffer tank may also comprise a closeable opening and a lid to close the closeable opening. In doing so, dirt and debris that may be sucked into the tank and that may have accumulated can be removed from the tank.

In an embodiment, the injection needle guide comprises a shutter assembly, wherein the shutter assembly is moveable between a closed state and an open state. In the closed state the shutter closes off the first passages.

Being able to close off the first passages does not only decrease the leakage because holes are closed, it also decreases the odds of the yarn getting stuck in the passages or exiting the system through the passages when it is not intended to do so. It thus creates a more efficient system.

In an embodiment, the shutter assembly comprises at least one slider and a slider actuator, wherein the slider actuator moves the at least one slider between the closed state and the open state.

In an embodiment, the shutter assembly comprises two sliders and wherein a first slider is located below the second passages and a second slider is located above the second passages. In doing so, both sides of the first passages can be easily closed off to ensure limited leakage.

In an embodiment, the at least one slider defines a number of slider holes, wherein in the open state of the shutter assembly, the slider holes are substantially aligned with the first passages, wherein in the open state the moveable injection needles are moveable through the first passages and the slider holes.

In an embodiment, the injection needle guide comprises a biased shutter located on a lower side of the hole, wherein a default position of the biased shutter is in the closed state and the biased shutter is configured to be moved into the open state by the downward movement of the moveable injection needles.

In doing so, no control system is necessary to operate the shutters. Additionally, the injection needles may remain in an upper part of the first passages, wherein the injection needles substantially close off the upper end of the first passages.

In an embodiment, the slider holes and/or the first passages are larger than the moveable injection needle in a direction substantially parallel to the second passages.

By using larger first passages and/or slider holes, the yarn sections are less likely to get stuck between injection needle guide and/or the slider and the needle.

In an embodiment, the fluid flow assembly comprises a waste receptacle removably located within the suction buffer tank. The waste receptacle comprises a plurality of holes and is configured to collect and retain waste entering the suction buffer tank from the fluid communication channel. The waste receptacle may be removed through the closeable opening.

In an embodiment, the fluid flow assembly comprises a pressure sensor located in the suction buffer tank and a control unit configured to read out the pressure sensor and provide a user with pressure data.

Based on the pressure data, the user and/or the control unit may determine whether the device is ready to be operated.

In an embodiment, each of the number of cutting devices comprises a yarn passage and a moveable knife. A yarn extends from the feeding device through the yarn passage and into a respective yarn tube, and the knife is moveable between an open state and a closed state. The knife may be configured to cut the yarn at the yarn passage when moved from the open state to the closed state.

In an embodiment, the knife closes off the yarn passage in the closed state and inhibits a fluid flow in the yarn tube. In doing so, the yarn section will not be dragged away by a drag force exerted on it by a fluid flow.

In an embodiment, the feeding device is at least partially located at a distance above the injection needle guide, wherein the distance preferably is 50-200 cm, more preferably is 75-125 cm.

Because it is beneficial for the needle guide to be located close to the ground, it may also be useful for the feeding device to be at least partially located at a distance above the injection needle guide. This permits an operator to reach the feeding device without having to get close to the ground.

In an embodiment, when seen in side view, the number of injection needles is located above the injection needle guide in the upper needle position, the number of yarn tubes is located on the right of the injection needle guide, the number of cutting devices is located on the right of the yarn tubes, the feeding device is located on the right of the number of cutting devices, and the at least one fluid communication channel is located on the left injection needle guide, and the depressurized compartment is located on the left of the injection needle guide.

In an embodiment, the device further comprises an actuation system, wherein the actuation system comprises hydraulics, pneumatics, and/or electronics configured to actuate the cutting device, the channel valve, the feeding device, the shutter assembly, the moveable injection needles, and/or the fluid flow assembly.

In an embodiment, the device further comprises a control unit, wherein the control unit is configured to control any of the cutting device, the channel valve, the feeding device, the shutter assembly, the moveable injection needles, and/or the fluid flow assembly.

In an embodiment, the control unit is configured to control a cycle, wherein in the cycle, the feeding device is operated to feed lengths of yarn to the injection unit, thereafter the number of cutting device cut the lengths of yarn and the injection needles inject the lengths of yarn in the substrate.

In an embodiment, the control unit controls a number of revolutions of the at least one roller to control the length of the length of yarn fed to the injection unit. By controlling the number of revolutions, the length of yarn that passes the rollers can be accurately controlled. In doing so, it becomes better possible to inject variable lengths of yarn into the substrate.

In an embodiment, the number of supply paths, the number of yarn tubes, the number of first passages, the number second passages, and the number of moveable injection needles, preferably is 2-200, more preferably is 50-150, even more preferably 60-80. A device with a small number of second passages may be used for a small pitch or to draw lines on a pitch. A device with a large number of second passage may be used for a large pitch.

In an embodiment, the fluid flow assembly comprises the first number of fluid communication channels.

In an embodiment, the device comprises a moving assembly, the moving assembly comprising a frame and wheels and/or tracks mounted to the frame, configured to allow the device to move over a surface.

In an embodiment, the suction buffer tank and the suction pump are located left of the injection needle guide and a drive system of the moving assembly is located right of the injection needle guide in side view to create an even weight distribution.

In another independent aspect, the invention relates to a method for injecting yarn sections into a substrate using a yarn injection device comprising:

- a yarn storage comprising a number of spool holders for holding a number of spools with yarn,
- a feeding device comprising:
  - a number of yarn tubes configured to accommodate yarn,
  - a number of cutting devices,
- the injection unit comprising:
  - an injection needle guide defining a number of first passages extending over a vertical distance and a number of second passages extending over a horizontal distance, wherein each first passage intersects a respective second passage, and wherein each yarn channel is fluidly connected to a respective second passage,
  - a number of moveable injection needles,
  - at least one needle actuator,
- a fluid flow assembly comprising at least one fluid communication channel and a depressurized or pressurized compartment having an underpressure or an overpressure, wherein the at least one fluid communication channel extends between the injection needle guide and the depressurized or pressurized compartment, the method defining a cycle comprising the steps:

a) supplying yarn from the yarn storage along the supply path to the feeding device, b) feeding a length of yarn into the number of yarn tubes of the injection unit with the feeding device, c) communicating a fluid flow to the number of yarn tubes to apply a drag force on the yarn and feed the yarn through the number of yarn tubes and the number of second passages of the injection needle guide, d) cutting the yarn into yarn sections with the number of cutting devices, wherein the yarn sections are at least partially located in the number of yarn tubes and the injection needle guide, e) moving the number of moveable injection needles downwards through the number of first passages, wherein the yarn sections are engaged by the number of moveable injection needles and are inserted in a substrate below the injection needle guide.

By applying such a method, a flow of fluid can be used to exert a drag force on the yarn, pulling the yarn through the device. In particular the yarn can be pulled through the injection needle guide. In the injection needle guide the use of the first and second passages enables the device to minimize a pressure drop because of leakage through open spaces.

In an embodiment, the at least one fluid communication channel comprises a channel valve that is moveable between an open state and a closed state, wherein prior to step d) the channel valve is moved from the open state to the closed state.

By being able to switch the channel valve between an open state and a closed state, the communication of the fluid flow may be regulated. The regulation of the fluid flow prevents the need for a system that continuously creates a pressure difference. The present device may create a pressure difference only when it needs the pressure difference. In doing so, the cost of the device can be minimized both in component cost and in energy consumption.

In an embodiment, the yarn tubes are extendable tubes and prior to step d), the number of cutting device is moved with respect to the intersections.

By using extendable tubes and moveable cutting devices, the length of a yarn section can be varied without increasing the open space through which leakage could occur. This is beneficial because the system can easily be adjusted for the circumstances required. For example, when injecting yarn sections in a football pitch, a desired injection depth could vary as a function of underground obstacles such as irrigation pipes. By easily being able to adjust the length of the yarn sections, the injection depth can be adapted without having to change out component and the like.

In an embodiment, prior to step d) the moveable injection needles are moved downwards to an intermediate position, wherein in the intermediate position, the needles exert a friction force on the yarn keeping the yarn in place during step d). This increase the accuracy of the cutting process.

In an embodiment, the fluid flow assembly further comprises a suction pump and a suction buffer tank and the at least one fluid communication channel is connected to the suction pump and/or the suction buffer tank. Herein, the fluid flow assembly creates an underpressure and/or a fluid flow in at least one of the feeding device, the number of yarn tubes, and the injection needle guide during step c). This creates a substantially uniform fluid flow wherein the drag force exerted on the yarn does not vary substantially throughout the device.

In an embodiment, the injection needle guide comprises a shutter assembly that is moveable between a closed state and an open state, wherein in the closed state the shutter assembly closes off the first passage, and wherein the shutter assembly is moved to the open state prior to step e).

Being able to close of the first passages does not only decrease the leakage because holes are closed, it also decreases the odds of the yarn getting stuck in the passages or exiting the system through the passages when it is not intended to do so. It thus creates a more efficient system.

In an embodiment, the shutter assembly is moved to the open state after the channel valve has been moved to the closed state. In doing so, a loss of pressure in the pressurized chamber can be minimized because it is exposed to atmospheric pressure for a period that is as short as possible.

In an embodiment, the shutter assembly comprises at least one slider and a slider actuator, wherein the slider actuator moves the at least one slider between the closed state and the open state.

In an embodiment, the shutter assembly comprises two sliders and a first slider is located below the number of second passages and a second slider is located above the number of second passages. In doing so, both sides of the first passages can be easily closed off to ensure limited leakage.

In an embodiment, the device further comprises a control unit and the control unit controls any of the cutting device, the channel valve, the feeding device, the shutter assembly, the number of moveable injection needles, and/or the fluid flow assembly.

In an embodiment, the control unit controls a number of revolutions of the at least one roller during step b) to control the length of the length of yarn fed to the injection unit.

In an embodiment, the number of supply paths, the number of yarn tubes, the number of first passages, the number second passages, and the number of moveable injection needles, preferably is 2-200, more preferably is 50-150, even more preferably 60-80.

In an embodiment, the cycle further comprises the steps:

f) moving the moveable injection needles upwards through the first passage, wherein the yarn sections are left in the substrate below the injection needle guide, g) moving the cutting device to the open state and moving the channel valve to the open state, h) repeating step a)-e).

In doing so, the cycle can be repeated to inject multiple yarn sections into a substrate.

In an embodiment, during step g) the number of cutting devices is moved to the open state after the channel valve is moved to the open state.

In an embodiment, the shutter assembly is moved to the closed state after the channel valve is moved to the open state and before the number of cutting devices is moved to the open state. This permits any dirt, debris, and/or waste to be sucked out of the needle injection guide.

In an embodiment, the shutter assembly is moved to the closed state before the channel valve is moved to the open state. This permits to minimize a loss of pressure.

In an embodiment, the fluid flow assembly comprises a pressure sensor located in the suction buffer tank and a control unit, wherein the control unit reads out the pressure sensor and provides a user with pressure data. Based on the pressure, the user and/or the control unit may determine whether the device is ready to be operated.

In an embodiment, the yarn injection device comprises a moving assembly and wherein the yarn injection device is moved over a lateral distance after step f) and before a subsequent step e) and wherein steps g)-d) are executed while the yarn injection device is moving.

This permits to inject yarn sections into a substrate at different locations and to do so in a time efficient manner.

In an embodiment, the time between a first step e) and a subsequent step e) is less than 10 seconds, in particular less than 5 seconds, more in particular less than 4 seconds.

DETAILED DESCRIPTION OF THE DRAWINGS

Figure 1:
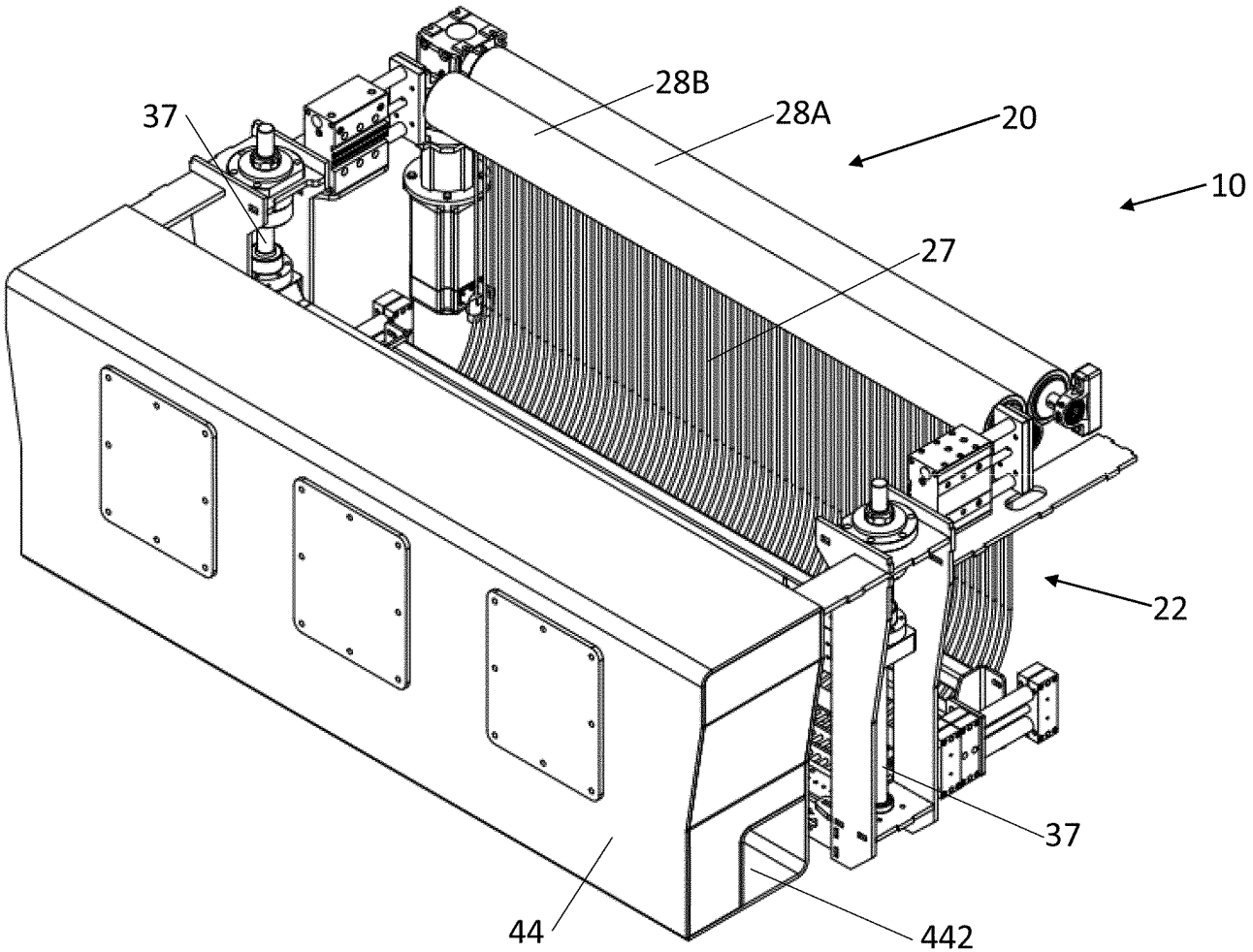
FIG. 1 shows an isometric view of a yarn injection device.
Figure 2:
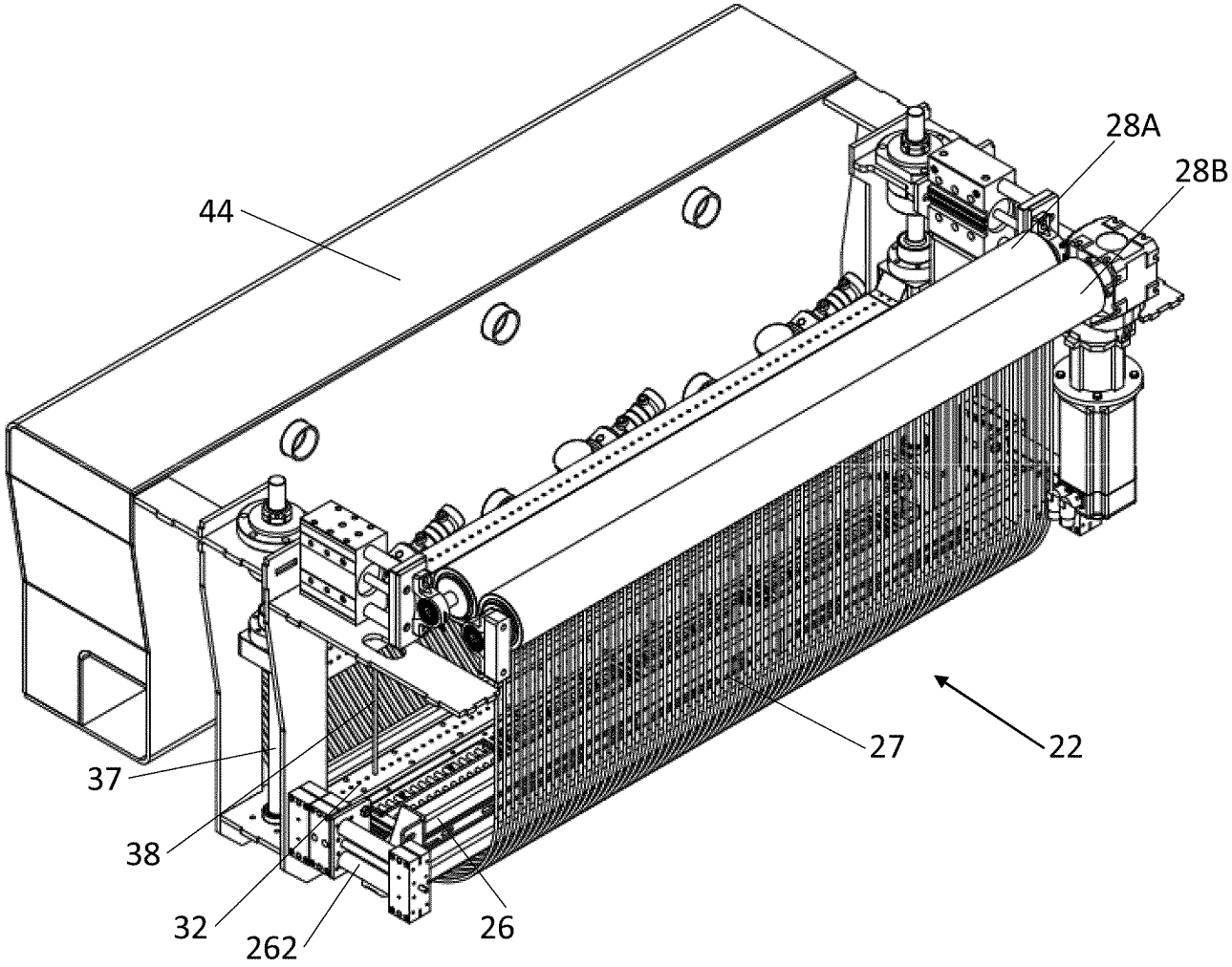
FIG. 2 shows an isometric view of a yarn injection device.

In FIGS. 1, 2, 3A, and 3B, a general overview of a yarn injection device 10 for injecting yarn sections 1 into a substrate 2 is shown.

A feeding device 20 is configured to feed lengths of yarn via supply paths 22 from spool holders of a yarn storage (depicted in FIGS. 8 and 9) via the feeding device and to an injection unit 30. To do so, the feeding device comprises a number of yarn tubes 24 that each define a yarn channel that is configured to accommodate yarn that is to be fed to the injection unit 30. In operation, when a desired length of yarn has been fed into and through the injection unit 30, a number of cutting devices 26 that are located at a side of the number of yarn tubes cut a number of yarn sections 1 from the yarn extending from the yarn storage into the yarn tubes.

When the yarn sections have been cut, the injection unit injects them into the substrate. To this end, the injection unit comprises an injection needle guide 32 that guides a number of moveable injection needles 38 into the substrate. Besides defining a number of first passages 34 that extend over a vertical distance 341 and are intended to guide the number of moveable injection needles, the injection needle guide 32 also defines a number of second passages 36 that extend over a horizontal distance 361. The second passages 36 are intended to guide yarn through the injection needle guide 32 and to below the number of moveable injection needles. For this reason each first passage intersects a respective second passage and each yarn channel us fluidly connected to a respective second passage.

Figure 3A:
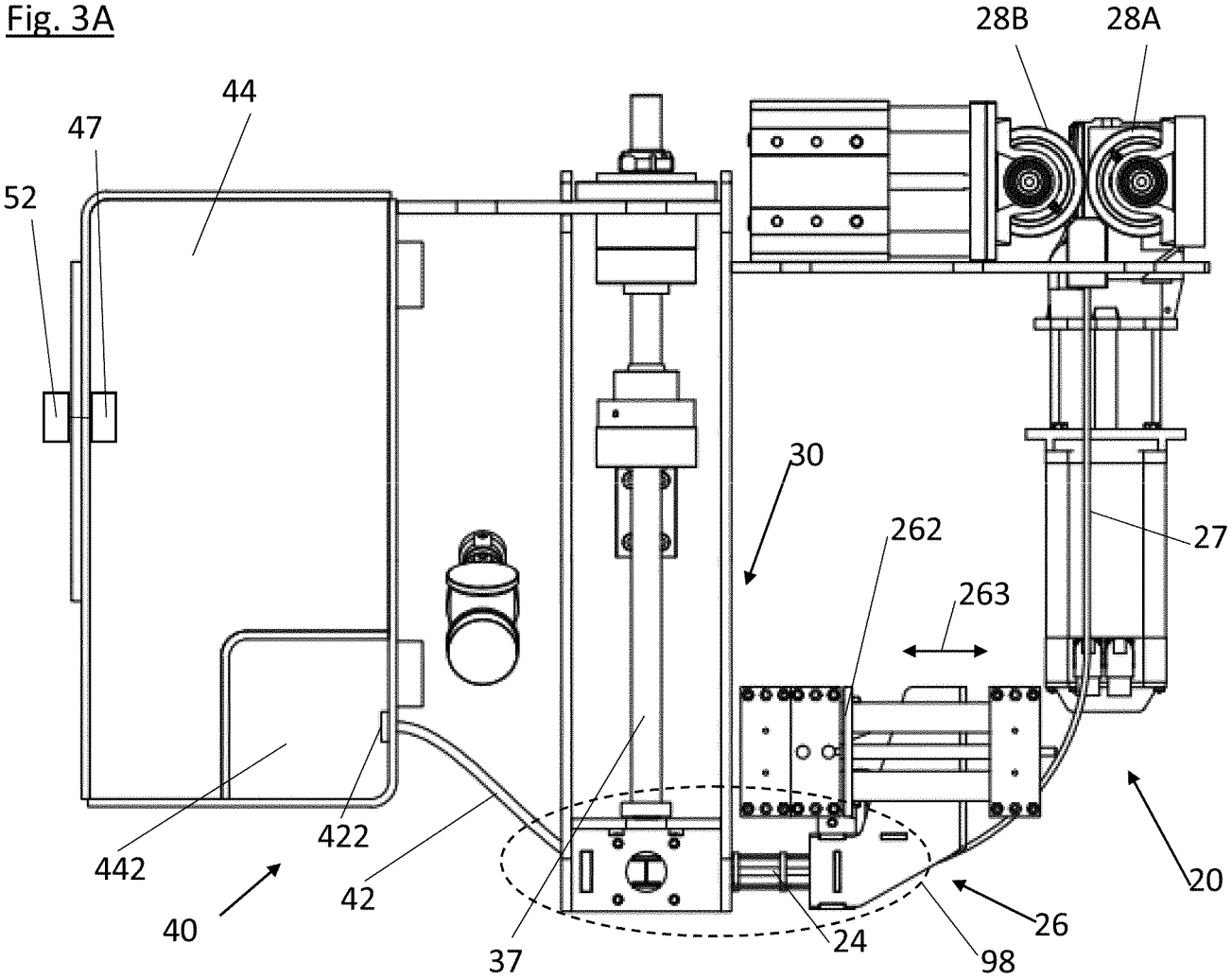
FIGS. 3A and 3B show a side view of a yarn injection device.
Figure 3B:
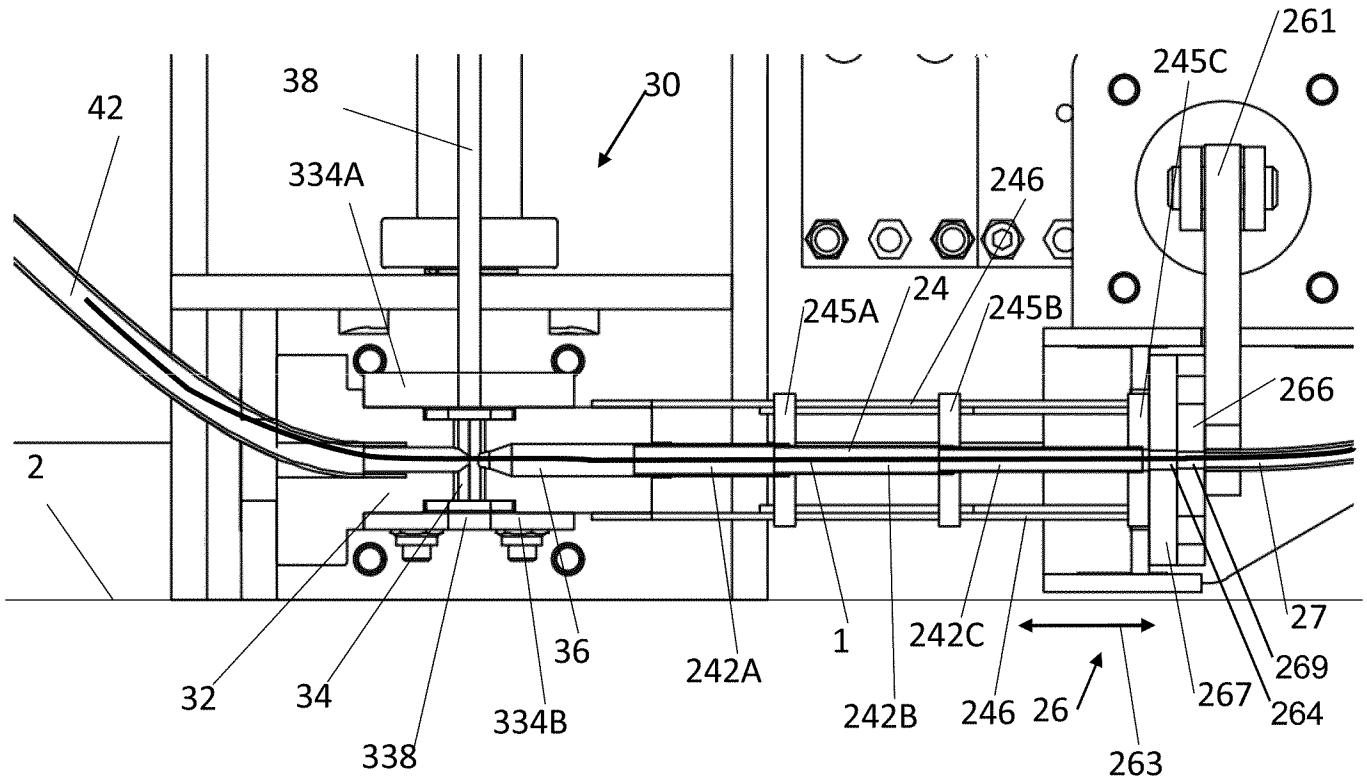

In the side views of FIGS. 3A and 3B, the injection needle 38 is located above the injection needle guide 32 in the upper needle position and the number of yarn tubes 24 is located on the right of the injection needle guide. The area denoted by numeral 98 in FIG. 3A is depicted in detail in FIG. 3B. The number of cutting devices 26 is located on the right of the yarn tubes and can be actuated by a cutting actuator 261, the feeding device 20 is located on the right of the number of cutting devices, and the fluid communication channel 42 is located on the left injection needle guide. The cutting device comprises a knife 266 that is moved with respect to a static part 267 by the cutting actuator 261 to cut the yarn. Here, the knife 266 is moved in a direction normal to the plane of the cross-section. However, other directions are also possible. The fluid communication channel 42 serves the purpose of communicating an underpressure from a depressurized compartment located on the left of injection needle guide 32 to the injection needle guide and the feeding device The depressurized compartment 44 is located on the left of the injection needle guide.

When a yarn is located below the moveable injection needles, the moveable injection needles can move from an upper needle position to a lower needle position while passing through the holes of the injection needle guide 32. This movement is actuated by at least one needle actuator 37. The yarn sections 1 in the yarn tubes are then injected into the substrate 2 during this movement. In order for the yarn section 1 not to get stuck in the device, a fluid flow assembly 40 comprising at least one fluid communication channel 42 and a depressurized compartment 44 is provided. Here, the fluid flow assembly is located on an opposite side of the injection needle guide 32 relative to the yarn tube 24 and the depressurized compartment has an underpressure. Because the fluid communication channel 42 extends between the injection needle guide 32 and the depressurized compartment 44, a flow of fluid can be created through the fluid communication channel 42, the injection needle guide 32 and the yarn tube 24 in order to apply a drag force on a yarn and move the yarn through the injection needle guide 32.

Because it would require a lot of energy to keep the depressurised compartment 44 under a constant underpressure while also communicating this underpressure with the outside world via any of the other components, a channel valve 422 is located between the depressurized compartment 44 and the injection needle guide 32. In an open state the channel valve 422 allows communication of a fluid flow between the depressurized compartment 44 and the injection needle guide 32, the number of yarn tubes 24 and/or the feeding device. In a closed state, the channel valve 422 inhibits communication of a fluid flow between the depressurized compartment and the injection needle guide, the number of yarn tubes, and/or the feeding device.

Since an underpressure is communicated to the injection needle guide 32, when an injection needle moves to an upper position after having injected a yarn section 1 into the substrate 2, a small amount of fluid will be sucked in through the first passage 34. The sucked in fluid will travel to the depressurized vessel and in doing so may suck along some debris (substrate that has attached itself to the injection needle, yarn waste, etc.). In order to prevent this debris to loosely fly around, a waste receptacle 442 is removably located within the depressurized compartment 44. Because the waste receptacle comprises a plurality of holes and acts like a filter, waste entering the depressurized compartment can be collected and retained before being thrown out after removing the receptacle.

Also, because fluid is not only sucked in through the injection needle 32 but also through other nooks and crannies, the underpressure in the depressurized compartment 44 may drop over time. To overcome this a pump may be connected to the depressurized compartment. A pressure sensor 47 is located within the depressurized compartment and is connected to a control unit 52 that is configured to read out the pressure sensor and to provide a user with pressure data so the user may intervene. The control unit may also control any of the cutting device, the channel valve, the feeding device the shutter assembly 33, the moveable injection needles, and/or the fluid flow assembly. In particular, the control unit is configured to control a cycle, wherein in the cycle, the feeding device is operated to feed lengths of yarn to the injection unit, thereafter the number of cutting device cut the lengths of yarn and the injection needles inject the lengths of yarn in the substrate.

As one will understand, different substrate conditions may require different injection depths of yarn, e.g. an irrigation pipe may be located close to the surface and requires a smaller injection depth than directly besides the pipe. If the depth of the injection will vary, to create a uniform yarn length above the substrate, the yarn section must be shortened. To be able to adjust the length of the yarn section 1, feeding device 20 can feed an adjustable length of yarn to the injection unit 30. A deeper penetration will require a longer length and a shallower penetration will require a shorter length. Also, the cutting device 26 is moveable along the direction indicated by arrow 263 (see also FIG. 3A) by a cutting device moving system 262 with respect to the intersection of the first passages 34 and the second passages 36 to adjust the cut length of the yarn section. To allow the moving of the cutting device, the yarn tubes 24 are telescoping tubes comprising three sections 242A, 242B, 242C that can slide into one another. The three sections 242A, 242B, 242C have an inner diameter that substantially matches the outer diameter of a subsequent tube to form a tight seal. Further, the yarn tubes 24 are guided by flanges 245 that are connected to guides 246 to allow the telescopic tubes to lengthen and shorten. To be able to operate under a wide variety of substrate conditions, the distance from the cutting device 26 to the intersection is adjustable over a continuous range of preferably 40-300 mm, more preferably 55-350 mm, even more preferably 90-200 mm in a stepless manner. In order to be able to adjust the length of the yarn section 1 and to communicate a pressure from the depressurized compartment 44 to the feeding device, the yarn tubes 24 are extendable. In particular, the yarn tubes are telescoping tubes. As can be seen, no clamping is done and is necessary to be done to be able to cut the yarn section 1.

Figure 4A:
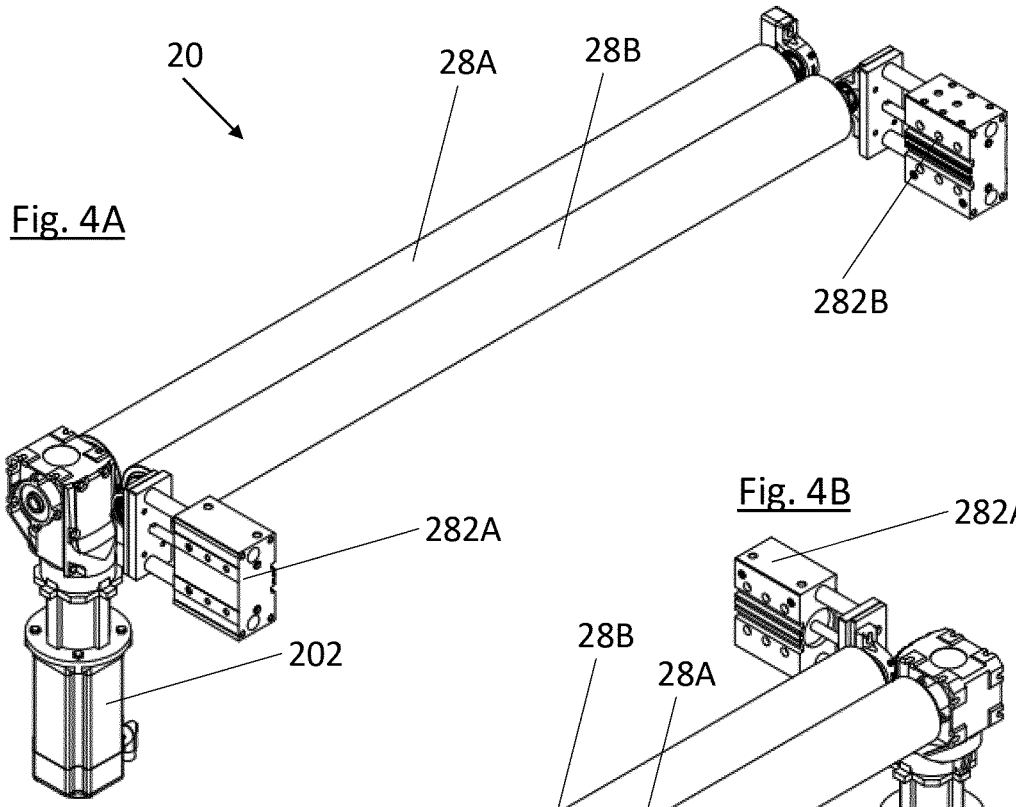
FIGS. 4A, 4B, and 4C show isometric views of part of the feeding device.
Figure 4B:
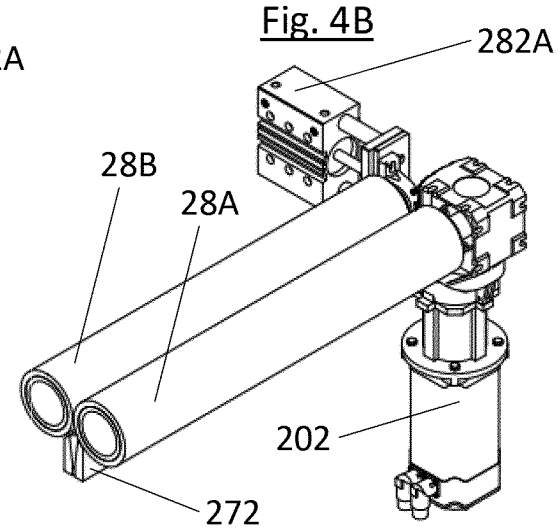
Figure 4C:
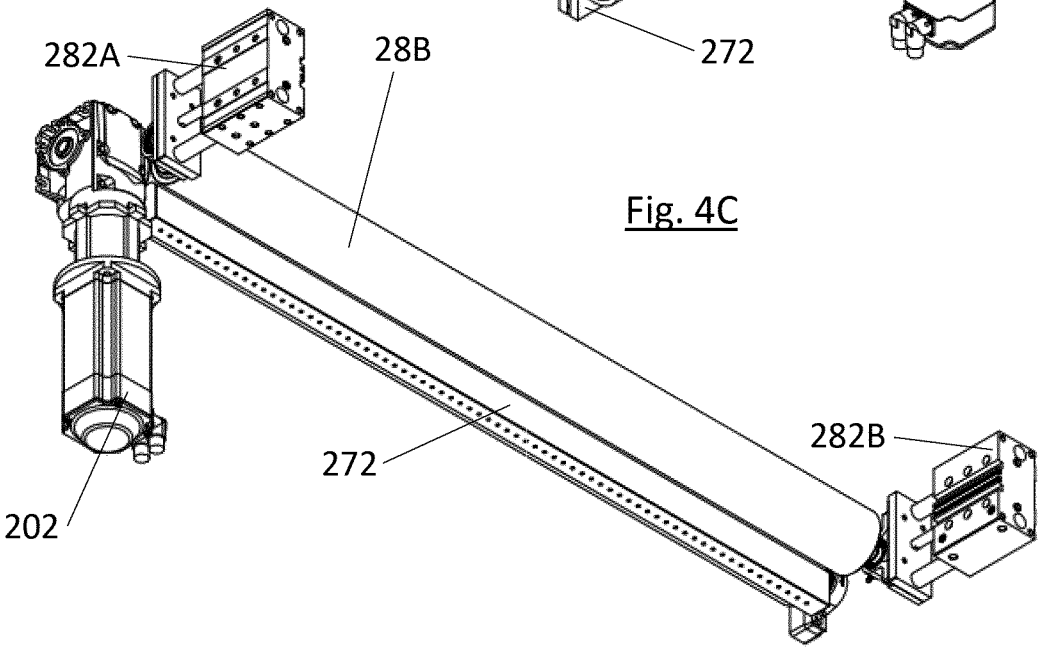
Figure 5A:
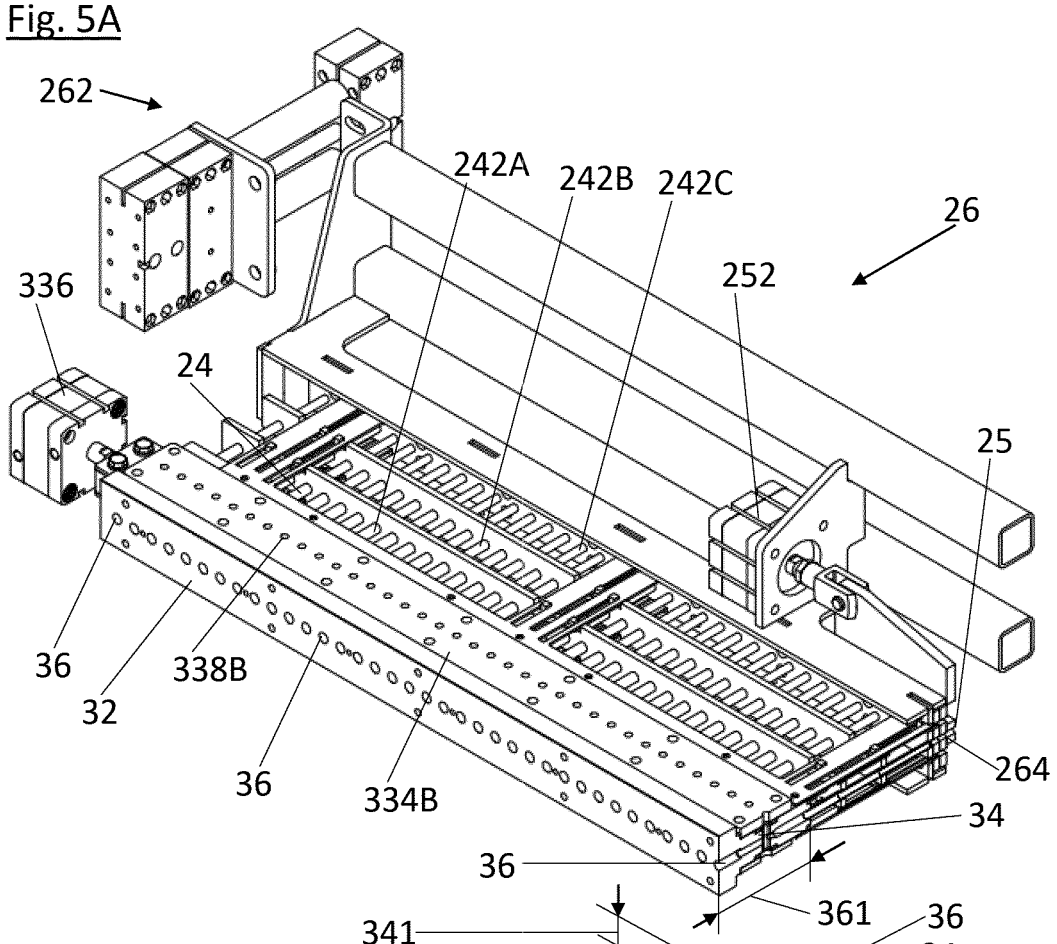
FIGS. 5A and 5B show the injection needle guide and part of the feeding device.
Figure 5B:
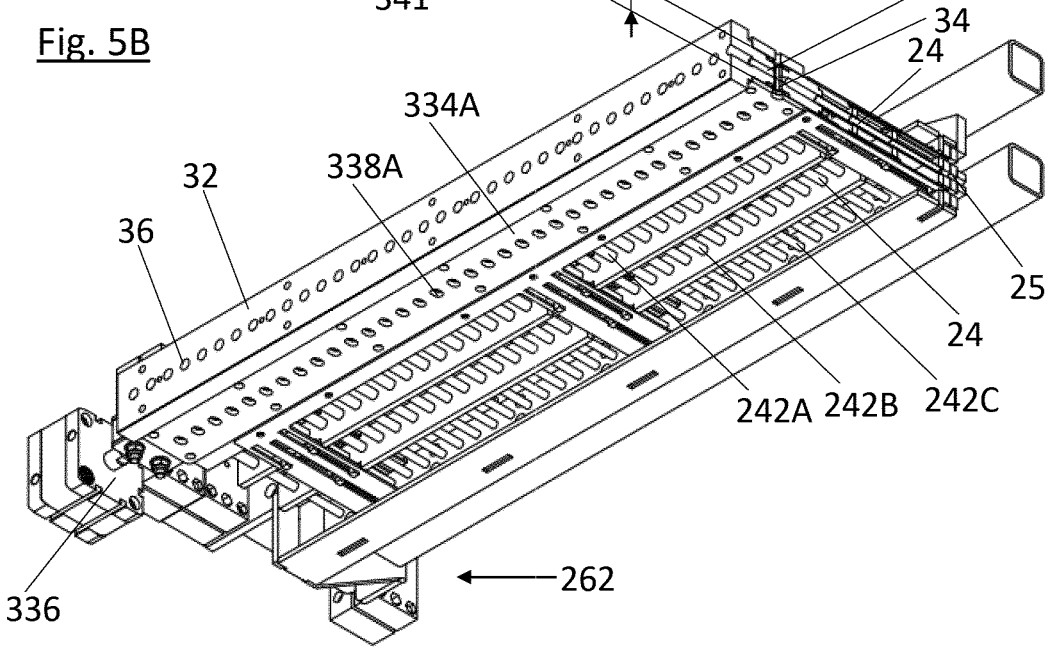

Looking at FIGS. 4A, 4B, and 4C, the feeding device 20 is shown independently. The feeding device 20 comprises two rollers 28A, 28B that have a continuous surface and are pressed together by a roller presser 282A, 282B. A roller presser can take multiple forms such as a spring or an actuator. During operation, a first end of a yarn is placed between the rollers and the rollers are driven by a roller actuator 202. The rotation of the rollers 28A, 28B then feeds the yarn to the injection needle guide. By letting the control unit control a number of revolutions of the hollers rollers 28A, 28B the length of the yarn section fed to the injection unit can be controlled. To guide the yarn to the yarn tubes 24, a feeding guide 272 guides individual yarns into feeding tubes 27 that extend to the cutting device. Because the feeding tubes 27 are of a constant length and are flexible, when the cutting device 26 and or the feeding device are moved together or relative to each other a distance between the cutting device and the rollers 28A, 28B along which a yarn extends, remains constant. The feeding device 20 may be located at a distance above the injection needle guide to make it easily accessible to an operator for the operator to place yarn between the rollers. Because the injection needle guide is located close to the ground, if the feeding device would be close to it, an operator would have to bend over to reach it. Therefore, the distance is in the range of 50-150 cm for the operator to easily reach the feeding device.

Turning to FIGS. 5A, 5B, 6A, 6B and 6C, the cutting device 26 is shown together with the injection needle guide 32. When a pressure is communicated to the injection needle guide 32, the fluid may escape through the first passages 34. To reduce the amount of lost pressure, the injection needle guide 32 comprises a shutter assembly 33 that is moveable between a closed and an open state in which it respectively closes off the first passages 34 and doesn't close off the first passages 34.

Figure 6A:
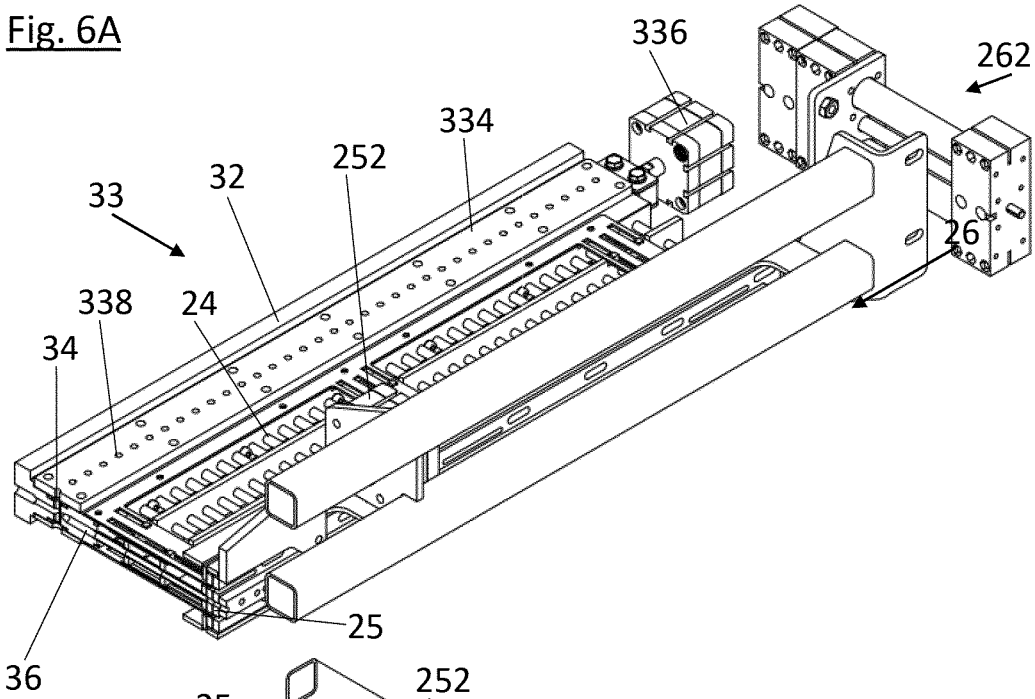
FIGS. 6A, 6B and 6C show the injection needle guide and part of the feeding device.
Figure 6B:
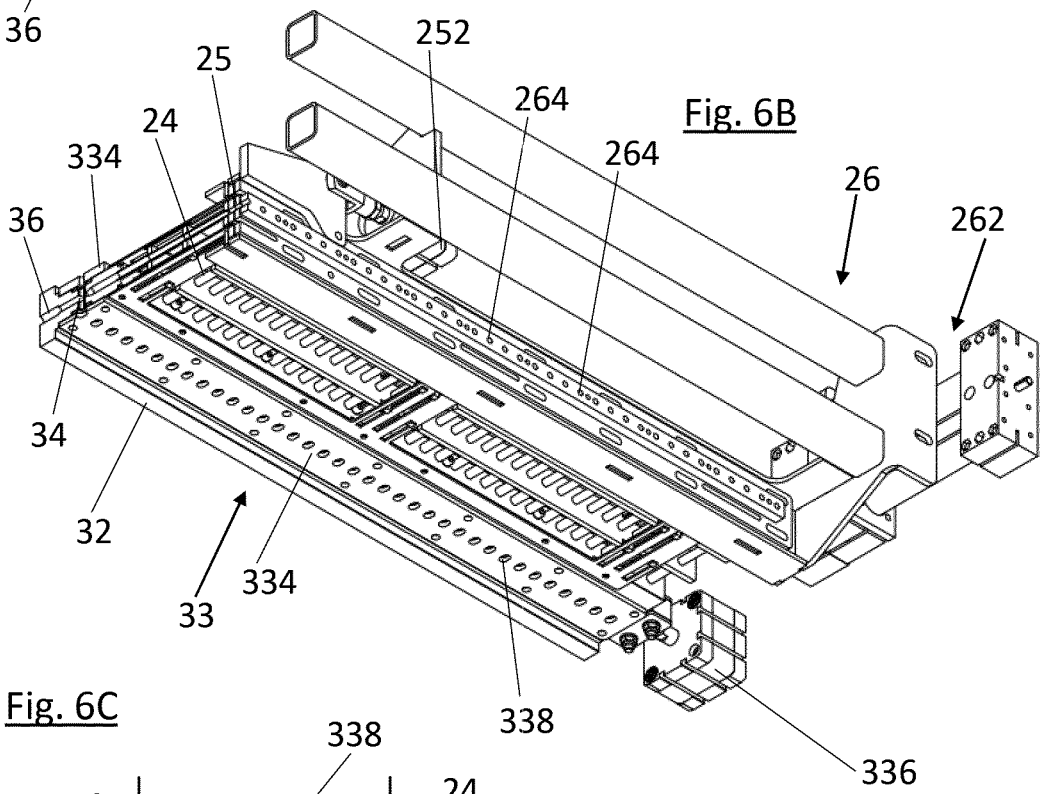
Figure 6C:
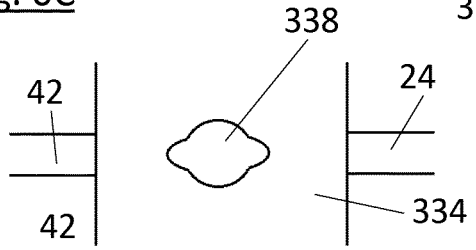

The shutter assembly comprises a first slider located 334A located below the second passages 36 and a second slider 334B located above the second passages 36. Each slider can be moved in a lateral direction by a slider actuator 336 between the closed state and the open state. In the open state, a number of slider holes 338A defined in the first slider 334A and a number of holes 338B defined in the second slider 334B substantially align with the first passages 34 for the moveable injection needles to be moveable through the first passages and the slider holes. In order for the moveable injection pin to be able to pass through the injection needle guide and the sliders, at least the number of slider holes 338A defined in the first slider 334A and the first passages 34 are larger than the moveable injection needle in a direction substantially parallel to the second passages 36. This is schematically depicted in FIG. 6C. Here, the large circular part of the hole 338 allows the needle to pass through and the oval sections extending to the sides accommodate the yarn when the needle passes through the injection needle guide together with the yarn. This allows the injection needle to extend through the slider hole and the first passage together with two ends of the yarn section next to it without jamming.

In the figures, the feeding tubes 27 have been left away to more clearly show the cutting device 26. The cutting device comprises a yarn passage 264 to which a feeding tube extends. The yarn passage is formed in the static part 267. After the yarn exits the feeding tube, the yarn passes through the yarn passage 264 of the cutting device and into the yarn tube 24 located on the opposite side of the cutting device relative to the feeding tube. A knife 266 is disposed in front of the yarn passages and is moveable between an open state and a closed state by a knife actuator 261. The knife may have the form of a plate with a number of holes 269. Each hole is associated with a yarn passage 264. The holes 269 may be conical. In the open state the holes 269 are aligned with the respective yarn passages 264. In the closed state the holes 269 are non-aligned with the yarn passages. By moving from the open state to the closed state, the knife cuts each yarn in each yarn passage. Because, in the closed state, the knife 266 closes off the yarn passage 264, it inhibits a fluid flow in the yarn tube 24.

Figure 7A:
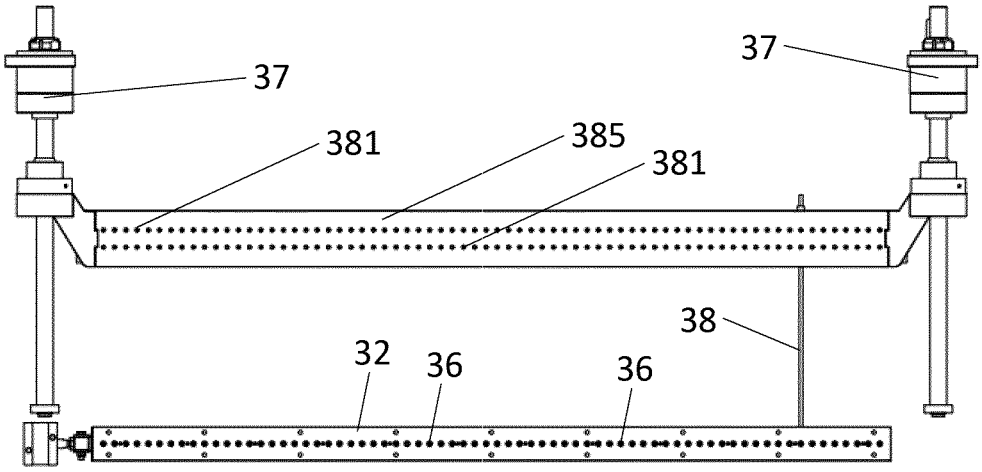
FIGS. 7A and 7B show the injection needle guide together with a moveable injection needle.
Figure 7B:
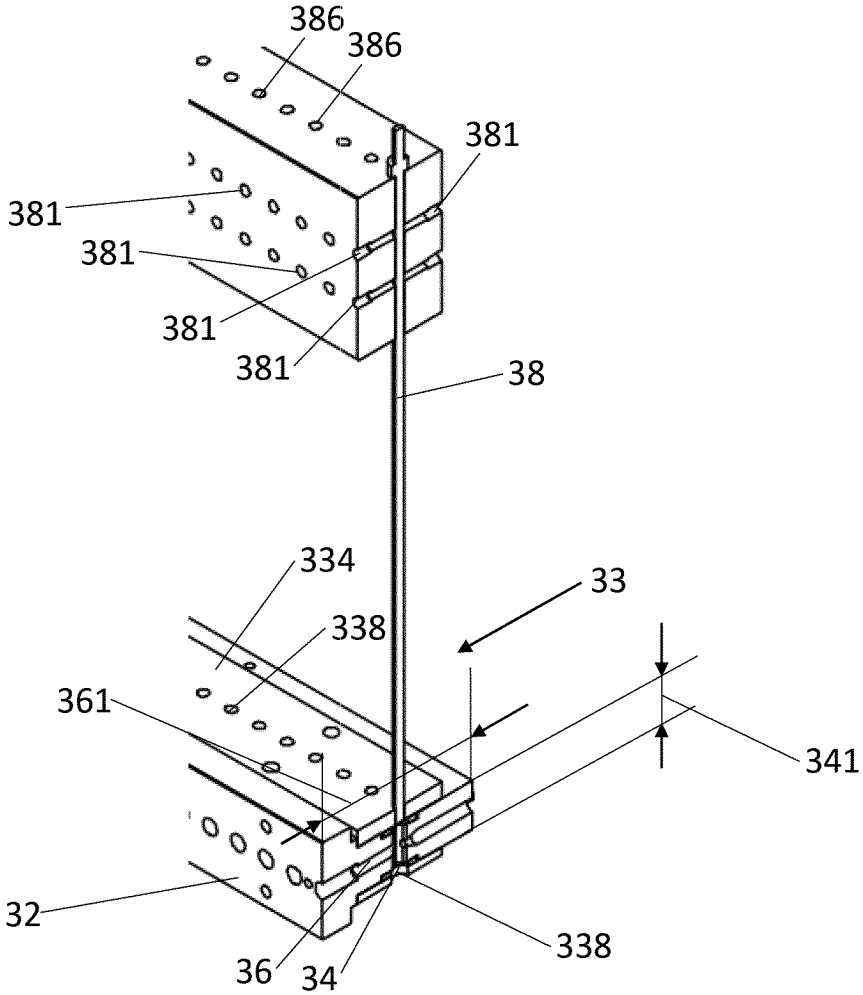

Turning further to FIGS. 7A and 7B, part of the injection unit is shown. In particular, a needle beam 385 is shown located above the injection needle guide 32. In order for the actuators 37 to move all injection needles 38 (of which only one is depicted) simultaneously, all the injection needles 38 are fixed to the needle beam 385. The needles are placed in needles holes 386 that extend through the needle beam. The needle beam 385 further defines fixating holes 381 in which a fixating means such as a screw can be threaded against the injection needle to fix the injection needle 38 to the needle beam 385. When the needle beam is moved in a vertical direction between an upper position and a lower position, the injection needles move through the injection needle guide 32.

Figure 8:
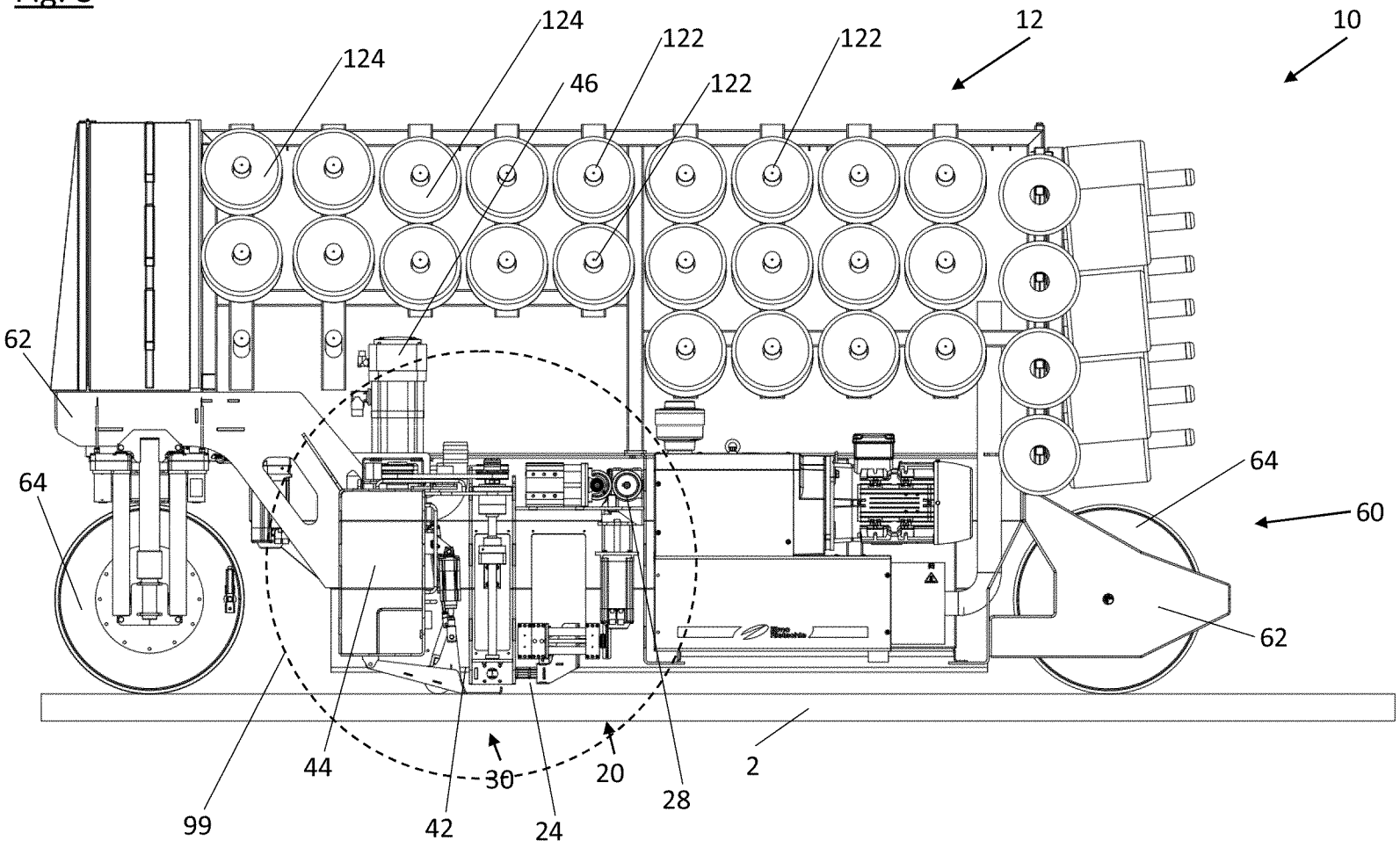
FIG. 8 show a side view of the yarn injection device comprising a moving assembly.
Figure 9:
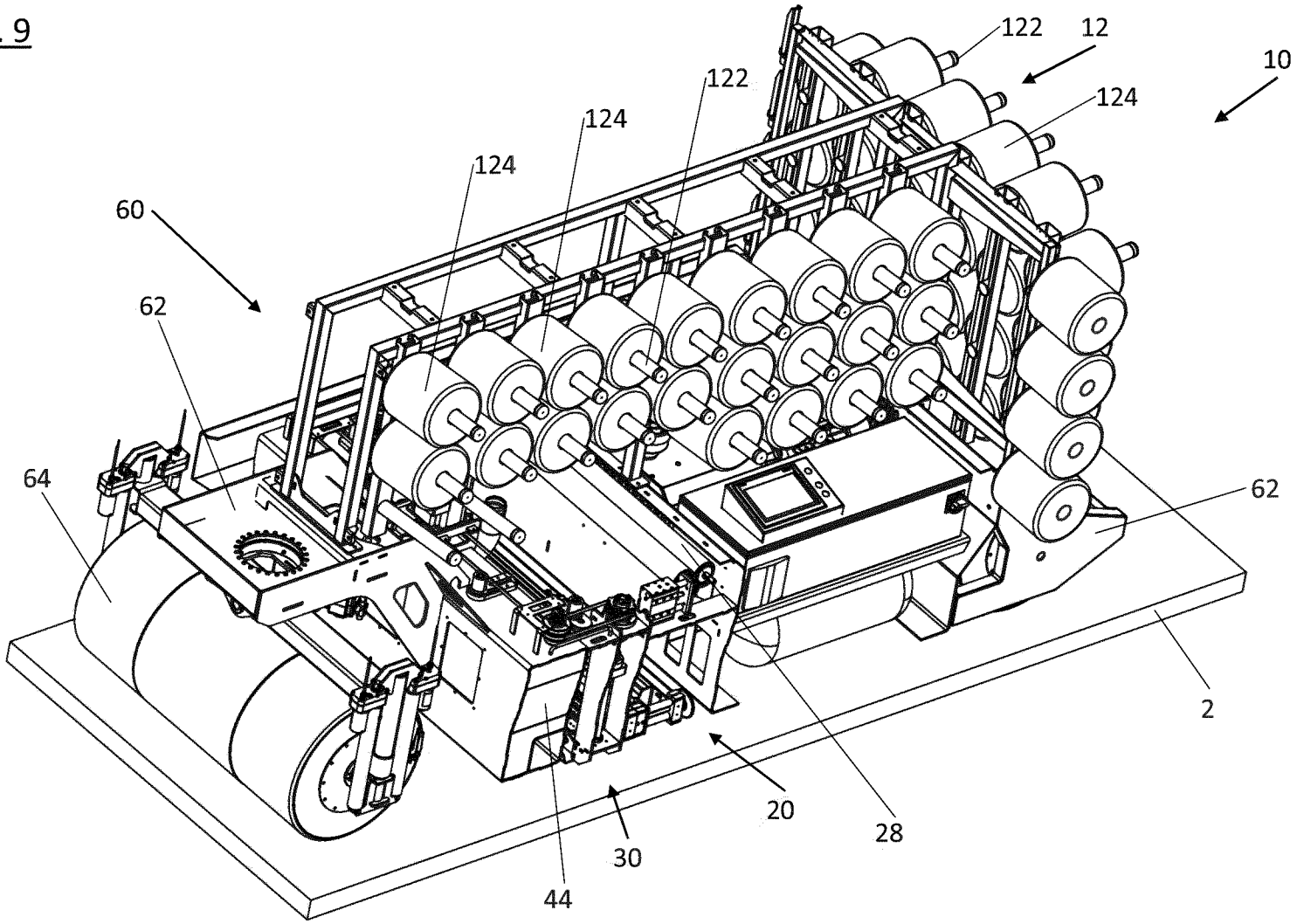
FIG. 9 show an isometric view of the yarn injection device comprising a moving assembly.

Looking at FIGS. 8 and 9, the yarn injection device further comprises a moving assembly 60 that is connected to the feeding device 20, the injection unit 20, and the fluid flow assembly comprising the depressurized compartment 44 and the fluid communication channel 42. The area denoted by numeral 99 is depicted in detail in FIGS. 3A and 3B. The moving assembly 60 comprises a frame 62 and wheels 64 that are mounted to the frame. When the injection needles have injected yarn sections into the substrate 2, the moving assembly 60 can be used to move the device over a surface of the substrate 2 to move to a subsequent injection location. Here, the yarn injection device can inject a following row of yarns sections.

Besides being connected to the feeding device 20, the injection unit 30, and the fluid flow assembly, the moving assembly 60 also supports the yarn storage 12. This yarn storage comprises spool holders 122 for holding spools 124 of yarn to store the yarns that are to be fed to the injection unit.

To create an even weight distribution, the depressurized compartment 44, i.e. the suction buffer tank, and the suction pump 46 are located left of the injection needle guide of the injection unit 30 and a drive system 66 of the moving assembly 60 is located right of the injection needle guide.

These parts are relatively heavy and therefore largely contribute to the weight distribution.

In a not depicted embodiment, the fluid flow assembly comprises a pressurized compartment instead of a depressurized compartment as described above. The pressurized compartment has an overpressure and the fluid communication channel extends between the injection needle guide and the pressurized compartment. The principle of operation and the general lay-out are substantially similar to that described above. The main difference is that the fluid communication channel does not connect to the injection needle guide on the left of the injection needle guide, but may connect to the injection needle guide, the yarn tubes, and/or the feeding tubes on the right side on the injection needle guide.

Similarly to the underpressure described above, the overpressure will create a flowing fluid passing through the second passage away from the feeding device and will, by exerting a force on the yarn, pull the yarn through the injection needle guide.

The terms "a" or "an", as used herein, are defined as one or more than one. The term plurality, as used herein, is defined as two or more than two. The term another, as used herein, is defined as at least a second or more. The terms including and/or having, as used herein, are defined as comprising i.e., open language, not excluding other elements or steps.

Any reference signs in the claims should not be construed as limiting the scope of the claims or the invention. It will be recognized that a specific embodiment as claimed may not achieve all of the stated objects.

The mere fact that certain measures are recited in mutually different dependent claims does not indicate that a combination of these measures cannot be used to advantage.

White lines between text paragraphs in the text above indicate that the technical features presented in the paragraph may be considered independent from technical features discussed in a preceding paragraph or in a subsequent paragraph.

The invention claimed is:

1. A yarn injection device for injecting yarn sections into a ground, wherein the yarn injection device comprises:

a yarn storage comprising a number of spool holders for holding a number of spools with yarn, a feeding device configured to feed lengths of yarn via respective supply paths from the storage to an injection unit, the feeding device comprising:

a number of yarn tubes, each yarn tube defining a yarn channel configured to accommodate a respective yarn, and a number of cutting devices located at a side of the number of yarn tubes and being configured to cut a number of yarn sections from the respective yarns extending from the yarn storage into the yarn tubes, wherein the feeding device is configured to feed an adjustable length of yarn to the yarn injection device, the injection unit comprising:

an injection needle guide defining a number of first passages extending over a vertical distance and a number of second passages extending over a horizontal distance, wherein each first passage intersects a respective second passage, and wherein each yarn channel is fluidly connected to a respective second passage, a number of moveable injection needles moveable between an upper needle position and a lower needle position and configured to pass through the first passages of the injection needle guide, wherein when yarn sections in the yarn tubes are located below the moveable injection needles and the moveable injection needles move downward through the injection needle guide, the yarn sections are injected into the substrate, and at least one needle actuator configured to move the number of moveable injection needles between the upper needle position and the lower needle position, a fluid flow assembly comprising at least one fluid communication channel and a depressurized compartment having an underpressure, wherein the at least one fluid communication channel extends between the injection needle guide and the depressurized compartment, wherein the supply paths extend from the respective spool holders via the feeding device to the injection unit, and the feeding device is configured to supply the yarns to the injection unit, and wherein the fluid flow assembly is configured to create a flow of fluid through each fluid communication channel, each injection needle guide and each yarn tube in order to apply a drag force on the yarns and move the yarns through the second passages in the injection needle guide, wherein the yarn injection device further comprises a cutting device moving system configured to move the number of cutting devices towards or away from an intersection of the first passages and the second passages.

2. The yarn injection device according to claim 1, wherein the at least one fluid communication channel comprises a channel valve located between the depressurized compartment and the injection needle guide, the channel valve being moveable between an open state and a closed state, wherein in the open state the channel valve allows communication of a fluid flow between the depressurized compartment and the injection needle guide, the number of yarn tubes, and/or the feeding device, and wherein in the closed state the channel valve inhibits communication of a fluid flow between the depressurized compartment and the injection needle guide, the number of yarn tubes, and/or the feeding device, wherein in particular the fluid is air.

3. The yarn injection device according to claim 1, wherein the feeding device is configured to feed an adjustable length of yarn to the injection device, and wherein the device further comprises a cutting device moving system configured to move the number of cutting devices towards or away from the intersection.

4. The yarn injection device according to claim 1, wherein the number of yarn tubes are extendable tubes extending between the injection needle guide and the cutting devices, and wherein the cutting device is moveable with respect to the intersection of the first passages and the second passages to vary the length of the extendable tubes.

5. The yarn injection device according to claim 1, wherein the yarn is not clamped prior to or during cutting.

6. The yarn injection device according to claim 1, wherein the feeding tubes are flexible and/or moveable.

7. The yarn injection device according to claim 1, wherein the fluid flow assembly further comprises a suction pump and a suction buffer tank, and wherein the fluid communication channel is connected to the suction pump and/or the suction buffer tank and the suction buffer tank is the depressurized compartment.

8. The yarn injection device according to claim 1, wherein the injection needle guide comprises a shutter assembly, wherein the shutter assembly is moveable between a closed state and an open state, and wherein in the closed state the shutter assembly closes off the first passages.

9. The yarn injection device according to claim 8, wherein the shutter assembly comprises two sliders and a slider actuator, wherein the slider actuator moves the two sliders between the closed state and the open state, and wherein a first slider is located below the second passages and a second slider is located above the second passages.

10. The yarn injection device according to claim 9, wherein each slider defines a number of slider holes, wherein in the open state of the shutter assembly, the slider holes are substantially aligned with the first passages, and wherein in the open state the moveable injection needles are moveable through the first passages and the slider holes.

11. The yarn injection device according to claim 10, wherein the injection needle guide comprises a biased shutter located on a lower side of the hole, wherein a default position of the biased shutter is in the closed state and the biased shutter is configured to be moved into the open state by the downward movement of the moveable injection needles.

12. The yarn injection device according to claim 1, wherein the slider holes and/or the first passages are larger than the moveable injection needle in a direction substantially parallel to the second passages.

13. The yarn injection device according to claim 1, wherein the fluid flow assembly comprises a waste receptacle removably located within the suction buffer tank, wherein the waste receptacle comprises a plurality of holes, wherein the waste receptacle is configured to collect and retain waste entering the suction buffer tank from the fluid communication channel.

14. The yarn injection device according to claim 1, wherein each of the number of cutting devices comprises a yarn passage and a moveable knife, wherein a yarn extends from the feeding device through the yarn passage and into a respective yarn tube, wherein the knife is moveable between an open state and a closed state, wherein the knife is configured to cut the yarn at the yarn passage when moved from the open state to the closed state, and wherein the knife closes off the yarn passage in the closed state and inhibits a fluid flow in the yarn tube.

15. The yarn injection device according to claim 1, wherein the yarn injection device further comprises a moving assembly, the moving assembly comprising a frame and wheels and/or tracks mounted to the frame, configured to allow the yarn injection device to move over a surface, wherein the suction buffer tank and the suction pump are located left of the injection needle guide and a drive system of the moving assembly is located right of the injection needle guide in side view to create an even weight distribution.

16. A method for injecting yarn section into a ground using a yarn injection device comprising:

a yarn storage comprising a number of spool holders for holding a number of spools with yarn, a feeding device comprising:

a number of yarn tubes configured to accommodate yarn, and a number of cutting devices, wherein the feeding device is configured to feed an adjustable length of yarn to the yarn injection device, and an injection unit comprising:

an injection needle guide defining a number of first passages extending over a vertical distance and a number of second passages extending over a horizontal distance, wherein each first passage intersects a respective second passage, and wherein each yarn channel is fluidly connected to a respective second passage, a number of moveable injection needles, and at least one needle actuator, and a fluid flow assembly comprising at least one fluid communication channel and a depressurized compartment having an underpressure, wherein the at least one fluid communication channel extends between the injection needle guide and the depressurized compartment, wherein the yarn injection device further comprises a cutting device moving system configured to move the number of cutting devices towards or away from an intersection of the first passages and the second passages, the method defining a cycle comprising the steps:

a) supplying yarn from the yarn storage along a supply path to the feeding device, b) feeding a length of yarn into the number of yarn tubes with the feeding device, c) communicating a fluid flow to the number of yarn tubes to apply a drag force on the yarn and feed the yarn through the number of yarn tubes and the number of second passages of the injection needle guide, d) cutting the yarn into yarn sections with the number of cutting devices, wherein the yarn sections are at least partially located in the number of yarn tubes and the injection needle guide, e) moving the number of moveable injection needles downwards through the number of first passages, wherein the yarn sections are engaged by the number of moveable injection needles and are inserted in a substrate below the injection needle guide, the method further comprising:

adjusting the length of yarn which is fed to the yarn injection device, and moving the number of cutting devices towards or away from an intersection of the first passages and the second passages by the cutting device moving system.

17. The method according to claim 16, wherein the at least one fluid communication channel comprises a channel valve that is moveable between an open state and a closed state, wherein prior to step d) the channel valve is moved from the open state to the closed state, wherein the cycle further comprises the steps:

f) moving the moveable injection needles upwards through the first passage, wherein the yarn sections are left in the substrate below the injection needle guide, g) moving the cutting device to the open state and moving the channel valve to the open state, h) repeating step a)-e), wherein the yarn injection device comprises a moving assembly, wherein the yarn injection device is moved over a lateral distance after step f) and before a subsequent step e), and wherein steps g)-d) are executed while the yarn injection device is moving.

18. The method according to claim 16, wherein prior to step d) the moveable injection needles are moved downwards to an intermediate position, wherein in the intermediate position, the moveable injection needles exert a friction force on the yarn keeping the yarn in place during step d).

19. The method according to claim 16, wherein the fluid flow assembly further comprises a suction pump and a suction buffer tank, wherein the at least one fluid communication channel is connected to the suction pump and/or the suction buffer tank, and wherein the fluid flow assembly creates an underpressure and/or a fluid flow in at least one of the feeding device, the number of yarn tubes, and the injection needle guide during step c).

20. The method according to claim 16, wherein the injection needle guide comprises a shutter assembly that is moveable between a closed state and an open state, wherein in the closed state the shutter assembly closes off the first passage, and wherein the shutter assembly is moved to the open state prior to step e).

* * * * *